US006989827B2

(12) United States Patent
Myers

(10) Patent No.: US 6,989,827 B2
(45) **Date of Patent: *Jan. 24, 2006**

(54) SYSTEM AND METHOD FOR TRANSFERRING DATA THROUGH A VIDEO INTERFACE

(75) Inventor: Robert L Myers, Loveland, CO (US)

(73) Assignee: Hewlett-Packard Development Company, LP., Houston, TX (US)

( * ) Notice: Subject to any disclaimer, the term of this patent is extended or adjusted under 35 U.S.C. 154(b) by 180 days.

This patent is subject to a terminal disclaimer.

(21) Appl. No.: 10/280,591

(22) Filed: Oct. 24, 2002

(65) Prior Publication Data

US 2004/0080523 A1 Apr. 29, 2004

(51) Int. Cl.
*G09G 5/00* (2006.01)

(52) U.S. Cl. ..... 345/204; 345/213

(58) Field of Classification Search ..... 315/169.3; 345/10, 99, 204, 209, 213, 694, 696, 698; 348/522, 572

See application file for complete search history.

(56) References Cited

U.S. PATENT DOCUMENTS

| | | | | | |
|---|---|---|---|---|---|
| 5,859,669 | A | * | 1/1999 | Prentice | 348/469 |
| 6,463,092 | B1 | * | 10/2002 | Kim et al. | 375/219 |
| 6,552,738 | B1 | * | 4/2003 | Lin et al. | 345/810 |
| 6,564,269 | B1 | * | 5/2003 | Martin | 710/20 |
| 2002/0167365 | A1 | * | 11/2002 | Smith | 331/100 |

* cited by examiner

*Primary Examiner*—Bipin Shalwala
*Assistant Examiner*—Laurel E LeFlore

(57) ABSTRACT

A method and system is provided for transferring data between a host and a video display through a video interface. The method includes the step of providing a horizontal sync line between the host and the video display with time intervals that are reserved for a horizontal sync signal. Another step is signaling to the host that the video display is able to participate in bidirectional data communications using the horizontal sync line. A further step is transferring data between the host and video display on the horizontal sync line during time intervals that are not reserved for the horizontal sync signal.

25 Claims, 7 Drawing Sheets

| Pin | Definition |
|---|---|
| 1 | Red Video |
| 2 | Green Video |
| 3 | Blue Video |
| 4 | (Optional) |
| 5 | Return |
| 6 | Red Return |
| 7 | Green Return |
| 8 | Blue Return |
| 9 | DDC +5V |
| 10 | Sync Return |
| 11 | (Optional) |
| 12 | DDC Data (SDA) |
| 13 | Horizontal Sync |
| 14 | Vertical Sync |
| 15 | DDC Clk (SCL) |

FIG. 1
(PRIOR ART)

Original Horizontal Sync.

Horizontal Sync with 1/N-rate clock
(/CLK_ENABLE asserted)

SYSTEM AND METHOD FOR TRANSFERRING DATA THROUGH A VIDEO INTERFACE

FIELD OF THE INVENTION

The present invention relates generally to a video interface.

BACKGROUND

The current analog video interface used in the personal computer (PC) industry is commonly referred to as the VGA standard and this interface has served for over 15 years in the personal computer (PC) world. This interface continues to be the de facto standard video connection and is still used with the vast majority of displays and graphics hardware sold today. Unfortunately, the VGA standard has not provided a significant amount of flexibility for expansion of its functionality, but it has survived over a relatively long and perhaps unexpected time period. In addition, this long used interface suffers from several shortcomings, especially in its suitability for use with fixed-format displays, such as liquid crystal displays (LCDs).

Newer and more capable interfaces have been introduced in an attempt to address these shortcomings. Two of the more widely recognized standards are the Plug & Display (P&D) standard from the Video Electronics Standards Association (VESA), and the Digital Visual Interface (DVI) standard from the Digital Display Working Group (DDWG). Both the P&D and DVI standards have offered a generally digital interface for use with non-CRT displays, under the belief that such displays are more suited to a digital form of video transmission.

These standards have seen very limited acceptance, primarily due to the lack of compatibility with the earlier VGA standard. Unfortunately, this means that fixed-format displays must continue to use the VGA interface despite its limitations. Displays with enhanced functionality have also been generally avoided because of the rigidity of the VGA standard.

SUMMARY OF THE INVENTION

The invention provides a method for transferring data between a host and a video display through a video interface. The method includes the step of providing a horizontal sync line between the host and the video display with time intervals that are reserved for a horizontal sync signal. Another step is signaling to the host that the video display is able to participate in bidirectional data communications using the horizontal sync line. A further step is transferring data between the host and video display on the horizontal sync line during time intervals that are not reserved for the horizontal sync signal.

Another embodiment of the invention includes a video display system for transferring data via an analog video interface between a host computing device and a video display. The system comprises an analog video display adapter located in the host computing device. A video display is configured to receive and display video signals from the analog video display adapter. A horizontal sync line is included to provide a horizontal sync signal from the analog video display adapter to the video display. A clock enable line is coupled to the analog video display adapter to provide a signal from the video display indicating that clock information can be sent across the horizontal sync line. A pixel clock signal is used in sampling the pixels in the video display using an analog video signal. The pixel clock signal is sent on the horizontal sync line during time intervals that are not reserved for the horizontal sync signal. A digital data stream is also transmitted to the video display on the pixel clock signal using an edge of the pixel clock signal.

BRIEF DESCRIPTION OF THE DRAWINGS

FIG. 1 is a table illustrating the pin layout for an analog VGA video adapter;

DETAILED DESCRIPTION

Figure 2:
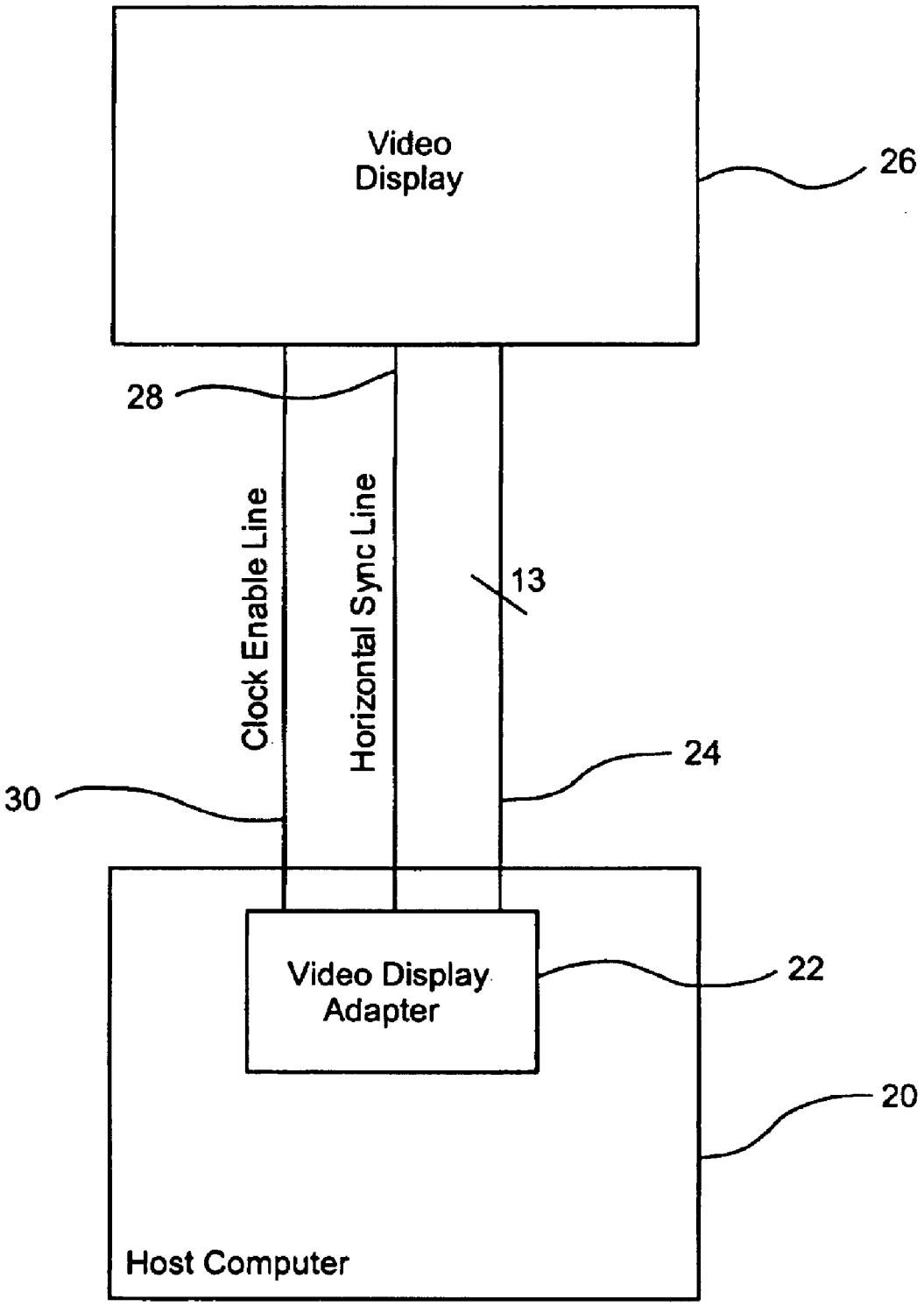
FIG. 2 is a block diagram depicting a connection between a video display adapter and a video display in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

A recent trend in the computer industry has been the introduction of video interface standards employing a digital transmission system. This trend is based on the belief that non-CRT display devices (such as LCDs) are "inherently digital" and are best served by a digital interface. However, this belief is not necessarily true. The majority of the popular non-CRT display technologies are distinguished from CRT displays primarily because they are fixed-format display devices not because they require digital input. This means that the display proper in such technologies provides a fixed number of physical picture elements or pixels through which the image information can be displayed to the user. These picture elements are generally arranged in horizontal rows and vertical columns. Some additional examples of fixed-format displays are plasma display panels, electroluminescent displays, field-emission display, organic-LED (OLED) displays, and any other display with discrete physical pixels.

A fixed-format arrangement does not necessarily define whether a fixed format display type is best served by digital or analog encoding of the image information. What is valuable in a fixed-format display is the accurate sampling of the incoming image information. Accurate sampling allows each sample of the image data to be assigned unambiguously to the proper physical pixel of the display device.

The fact that many "digital" interfaces directly provide a sampling clock for accurate pixel sampling makes them well suited for use with fixed-format displays. Regrettably, a lack of backwards compatibility, cost, and added complexity has been a large hurdle for these standards to overcome in finding widespread adoption.

New analog video standards employing different interfaces have been proposed in the past, but these standards have suffered from being completely incompatible with the existing VGA standard. One example of such a standard is the VESA Enhanced Video Connector or EVC. Gaining access to the features of this new standard requires use of a new connector, rather than being usable at least to some degree with the existing connector. So again, these newer standards have seen limited acceptance.

In contrast, the analog video standards used to date have not provided timing information to a degree finer than signaling the start of each new line. As a result, fixed-format displays supporting such interfaces have generally derived their sampling clocks from this line timing or horizontal synchronization signal (sync signal) with limited accuracy. When a fixed-format display receives a video signal from an analog video adapter (e.g. VGA), the fixed-format display does not know exactly where the active video line begins or ends, but the analog video can be roughly and sometimes inaccurately sampled according to the horizontal sync signal. Unfortunately, a certain amount of error is introduced when a secondary clock is derived from the horizontal sync signal. This is because the horizontal sync signal is already unstable and contains a significant amount of noise due to the instability of the signal in time with respect to the video data signal. In other words, there is a significant amount of jitter and skew of the horizontal sync signal with respect to the video data signal. Furthermore, the horizontal sync signal was not intended to be a frequency reference. When the horizontal sync signal is multiplied up by a factor of hundreds or thousands to get a pixel rate clock signal, the noise in the signal is magnified.

Even if a separate timing line is provided using an available pin in an analog video interface, it is difficult to correlate that clock input with the analog RGB (Red, Green, Blue) video input. Controlling the skew or alignment between a separate clock signal and the active RGB video is generally not feasible. There may be delays in the output from the circuits generating the signals and variations in the cable lengths used. This means that the display will not be able to synchronize an independent clock signal with the RGB video to within nanoseconds, as needed. In other words, the lack of synchronization between a separate clock signal and the video signal means that implementing a clock signal on a separate line is not a highly desirable option in an analog video interface.

In light of these problems, the present system and method provide an analog video system capable of properly supporting fixed-format display types by including a sampling clock, or a signal from which such a clock may be more accurately derived. In order to supply this information, the present invention provides a timing signal or pixel sampling clock at a pre-determined rate via the analog video interface that is already in use. Thus, the present invention supports new display types, while permitting true backwards compatibility with the existing analog interface. Further, the present invention is able to communicate additional independent data using the sampling clock signal.

The addition of a sampling clock can be achieved using an existing analog VGA interface standard as one embodiment of the invention. Therefore, a system may be defined that provides a high degree of backwards compatibility. These additional features can be incorporated into existing analog interface standards, in a way that maintains compatibility with existing displays and graphics hardware.

In order to understand the present invention, it is helpful to first describe one specific existing analog interface. Following this description, the enhanced signal definition and method for communication of data with the enhanced signal will be presented in further detail. This description will include the modifications to be made to the interface signals and their application within the current analog or digital systems.

The current de facto standard interface or VGA standard is based on a 15-pin high density D subminiature connector with a pinout as shown in FIG. 1. In addition, the following basic specifications are established for this system:

A. There are three video signals, providing luminance information for each of three primary color channels (Red, Green, and Blue). These are positive white signals where increasing the positive signal voltage with respect to the reference increases the luminance of that channel on the display. The signals have an amplitude of approximately 0.7Vp-p, with an impedance of 75 ohms, and the signals are assumed to be AC coupled in order to block certain levels of DC voltages. The reference level for these signals is established by requiring that all three of the channels be at a defined blanking level during the time around the horizontal sync pulse or interval, at which time the display will "clamp" or set an internal reference to this level. Each video signal is provided with a dedicated return line or ground.

B. In the VGA standard, timing information is not directly provided by the video signals themselves. Instead, horizontal line and vertical frame or field synchronization signals (syncs) are provided in the form of separate TTL signal lines, each on their own pin but sharing a common return.

C. Display identification and control is provided through a general purpose communications channel, established by the VESA Display Data Channel standard. This occupies pins 9, 12, and 15.

The modifications to these signal definitions in the present invention are made so that an enhanced video display adapter or host will still be capable of driving an old VGA display without difficulty. This provides backwards compatibility along with new functionality. Further, a display that is capable of using the enhanced functions can still be made to work generally within the original interface definition. When an analog video display interface is discussed in this description, the specific VGA interface has been referenced. In addition to the VGA interface, other video display interfaces can be enhanced with the features and elements of the present invention.

An embodiment of the invention takes advantage of two pins defined as optional or reserved in existing definitions, and uses one of these to indicate compatibility with the enhanced system. FIG. 2 illustrates that a host computer 20 can contain an analog video display adapter 22 (e.g., a graphics card) that outputs analog video signals. A video display 26 (e.g. fixed format) is included in the system to receive and display video signals from the analog video display adapter.

Under this improved system, a pixel clock signal is provided by inserting a clock signal of a pre-determined pixel rate (such as 1/N of the actual pixel clock rate) Onto the horizontal sync signal 28, except during the period normally occupied by the horizontal sync pulse. This pixel clock signal is sent on the horizontal sync line when the display has signaled that it can accept such a clock. One way of confirming that the display can receive the enhanced signal is by grounding a pin. For example, pin 4 can be grounded in the VGA interface. This line was previously optional and is now seen by the host as the /GLK_ENABLE 30. If the display does not enable this pixel clock by grounding this pin, the horizontal sync pulse is transmitted normally. In addition, the remainder of the video display lines 24 will continue to transfer information as defined by the analog video interface definition. The remaining video lines are illustrated by conventional circuit diagram notation with a slash across a single line and the number of data lines represented next to the line (13 data lines in this case).

There are other ways of confirming that the display is able to receive the enhanced signal. One way the display can signal its capability for accepting the pixel clock signal is via the display identification information contained in the Extended Display Identification Data (EDID) file, which is a VESA defined block of information communicated over the Display Data Channel (DDC). Alternatively, a confirmation signal can be sent on a separate signal line when no other information is being sent to the display on that separate line. Another possible confirmation method is the use of an extended connector that is backwards compatible with the VGA standard but provides additional lines that are recognized when connected to the enhanced video display. For example, the 15-pin D connector can include an expanded connector portion for new video display adapters and displays to use, which would not interfere with the normal connection of the 15-pin D connector. This latter type of implementation may increase cable costs but it provides a simple way of enabling the system. Other suitable handshake means can also be devised by those skilled-in the art.

Figure 3A:
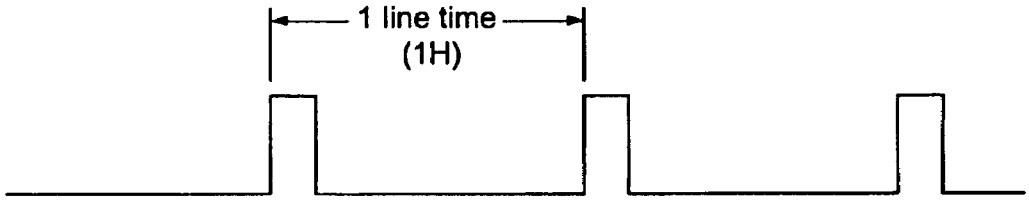
FIG. 3A illustrates the output from a horizontal sync signal line.
Figure 3B:
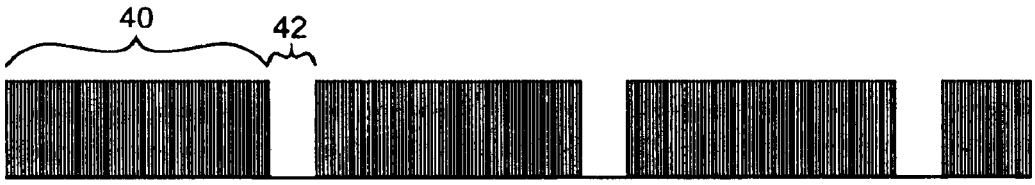
FIG. 3B illustrates an enhanced horizontal sync signal with a 1/N pixel rate clock as in an embodiment of the present invention.

FIG. 3A illustrates a wave form for a horizontal sync signal where a pulse is generated to signal the beginning of each horizontal line of pixels in the CRT. Displayed directly below the horizontal sync signal in FIG. 3B is the modified horizontal sync signal with the pixel clock signal.

When the /CLK_ENABLE line is held low by the display, a 1/N rate pixel clock can be transmitted on the horizontal sync line 40. For example, a ⅛ rate pixel clock can be used. In addition, no signal is transmitted during the time that corresponds to the horizontal sync pulse in the conventional interface definition 42. In other words, the clock is absent when the horizontal sync pulse would have been sent and the duration of this absence now defines the duration of the horizontal sync pulse as seen by the enhanced display. Absence of the clock is defined as the lack of a transition on this line for a pre-defined number of successive periods with the sense of the horizontal sync pulse set by the state of the line during the horizontal sync pulse time. In the example of a ⅛ rate clock, three periods or 12 pixel times can be the pre-defined number of successive periods. The host's pixel clock generator will advance the position of the horizontal sync by the defined number of pixel times (e.g., 12 pixel times) to compensate for the delay inherent in this system. Upon receiving three successive clock transitions at the end of the horizontal sync pulse time, the display will know that the horizontal sync pulse has terminated.

In the situation where the /CLK_ENABLE input line at the host is not grounded or is floating, the horizontal sync line is used as originally defined by the analog interface definition (e.g. VGA). This means that the horizontal sync pulse is provided to the display with its horizontal sync pulse according to the well-known definition as illustrated in FIG. 3A. In essence, the horizontal sync pulse is passed through unchanged.

If the display is holding the /CLK_ENABLE input line low but it detects no clock activity on the horizontal sync line, the display can assume that the host is not compatible with this enhanced system. Then the display will use the horizontal sync line as originally defined. The display determines whether or not there is clock activity on the horizontal sync line based on whether it detects regular transitions on the line above a pre-determined threshold rate. For example, a 2 MHz rate can be set as the pre-determined threshold rate.

The use of an ⅛ rate clock permits up to 500 MHz pixel rates to be supported with no higher than a 62.5 MHz signal on this line. It is assumed that displays supporting this system will provide suitable cabling for this signal. The use of a ⅛ pixel clock provides the advantage that the clock can be sent at a lower rate and then multiplied up on the display side using a programmable phase locked loop (PLL). This avoids some of the problems associated with sending a high frequency signal across a cable that was not necessarily designed for higher frequencies. Of course, other pixel clock rates can be used such as the actual pixel clock rate, ½, ¼, 1/16, or 1/32 pixel clock rates or other suitable pixel clock rates.

Figure 4:
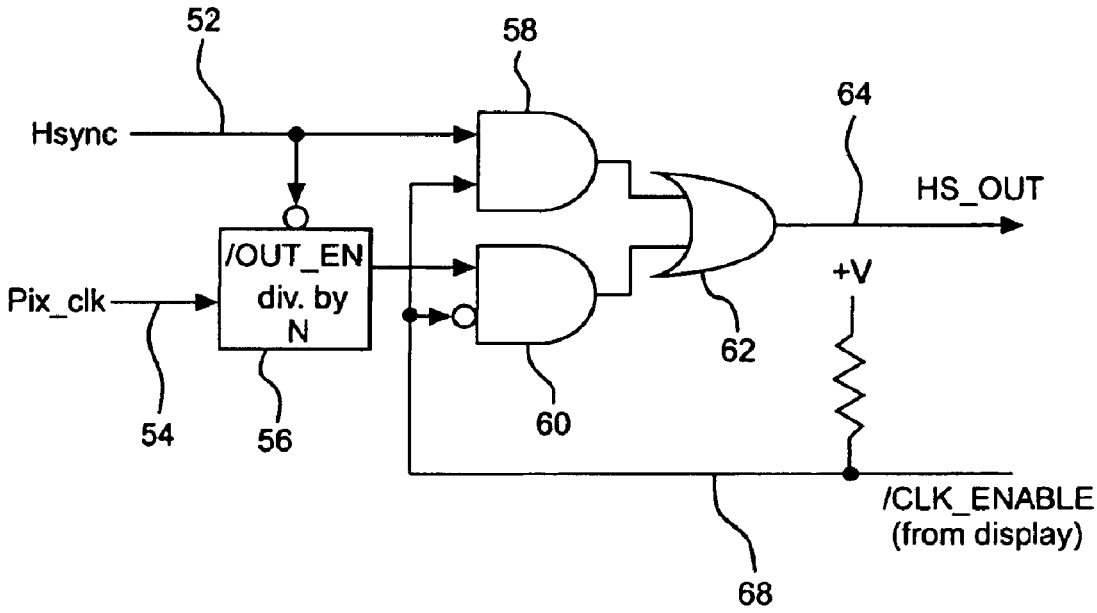
FIG. 4 is a schematic diagram of a circuit for providing a clock signal on a horizontal sync signal line in an embodiment of the invention.

FIG. 4 illustrates a schematic diagram of a circuit used to combine the horizontal sync signal and pixel clock modes on the horizontal sync line. This schematic should be viewed as a functional or logical description of how the circuit may work and alternative implementations may be devised. In FIG. 4, the horizontal sync input 52 is received from the analog interface (FIG. 3A) and this signal is delivered to a first AND gate 58. An incoming pixel clock signal 54 is provided to a dividing module 56, which also receives the inverted horizontal sync signal. The output of the dividing module is an enhanced output where the clock signal has been divided by some factor N (e.g. the factor 8) and combined with the inverted input from the horizontal sync signal (FIG. 3B). This pixel clock signal is sent to a second AND gate 60. The first and second AND gates are effectively enabled or disabled by the /CLK_ENABLE line 68 which provides an input to the first AND gate and an inverted input to the second AND gate. This means that when the first AND gate is disabled by the /CLK_ENABLE line being held low, then the second AND gate will be enabled to send the enhanced signal to the OR gate 62. When the /CLK_ENABLE signal is floating or high, then the reverse situation applies. The signal from the currently enabled AND gate is then passed through the OR gate and is the transmitted on the /HS_OUT line 64 (horizontal sync output line) to the display.

Bi-Directional Data Communications

The redefinition of the horizontal sync line to carry a high frequency sampling clock provides a means for enabling bi-directional data communications to be supported within an existing analog interface and even some digital interfaces. This embodiment of the invention can provide support for the transmission of display related commands, text information, copy protection systems, audio or other applications that can use a digital communications channel which is embedded with the video signal information.

To provide this functionality, it is assumed that the sampling clock PLL (phase locked loop) within the video display will be capable of free-running, without sufficient drift so as to be problematic, when the 1/N pixel clock reference is not provided for a short time during the vertical blanking interval. It is helpful (but not required) for this clock reference to be provided during the latter portion of the vertical blanking interval for a sufficient time in advance of active video for the sampling clock to be properly re-established. Further, as is the case with current composite sync systems, the horizontal sync pulse itself can be disabled for a similar short period during vertical blanking.

Since the horizontal sync pulse is disabled during vertical blanking, the horizontal sync line can be used for an alternate purpose. In this case, the horizontal sync line can be used for the transmission of digital data. During the vertical sync pulse or interval, no horizontal sync pulses will be asserted on the horizontal sync line nor will the 1/N pixel clock reference be transmitted. For example, current video timing standards use a vertical sync pulse that is typically 3 horizontal line times in duration.

Figure 5:
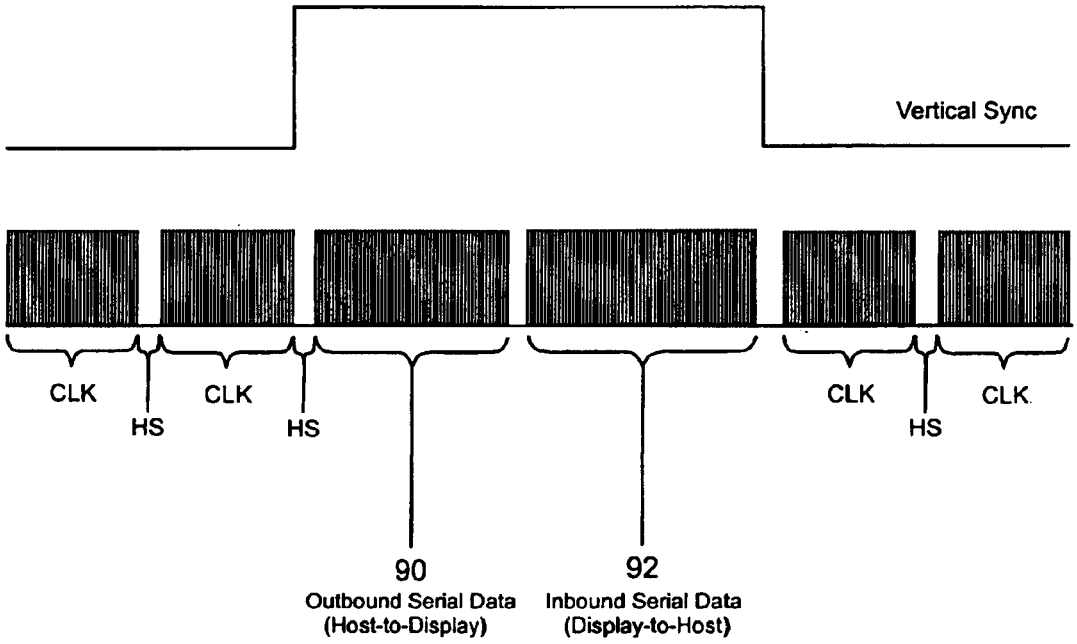
FIG. 5 illustrates a vertical sync pulse waveform and a corresponding pixel clock signal for sending data during the vertical sync pulse in accordance with an embodiment of the present invention.

Instead, the horizontal sync line will be used to carry serial data, at a bit rate equal to 1/N the current pixel clock so that the same reference clock may be used for both. For example, a ⅛ pixel clock can be used which provides the advantages described above. FIG. 5 illustrates that the first portion of the vertical sync period 90 can be used for outbound communications or host-to-display data. After this, the host can remove the data driver from this line and ready itself to receive display-to-host data 92 (if any) from the display. The timing of these transactions may be as shown in FIG. 5. This system and method of transferring data provides a bi-directional serial data path at 1/N of the pixel clock rate for any data between the host and video display. Many different clock speeds can be used for the present invention and any data on the vertical sync signal line will be at the selected clock speed. In addition, it is possible for the inbound or outbound data transmission to take all or just part of the transmission time on the horizontal sync line during the vertical sync period.

The typical worst case data rate supported for common computer displays would be in the case of a 640×480 transmission, in which the total horizontal line time is equal to approx. 800 pixel times. This can permit a data rate of almost 100 bits/line time using a ⅛ pixel clock or 800 bits per line using a pixel rate clock, given an equal division of the vertical sync period between "outbound" and "inbound" data. Taking into account three line times per vertical sync period, and a 60 Hz frame rate, such a system a ⅛ pixel clock can theoretically provide a transmission rate in the range of 6–9 Kbits/sec in each direction, depending on the overhead requirements of the interface.

One particular advantage of the system and method of the present invention is it allows data to be sent over an analog or digital video connection without the need for an extra data transmission line. This is particularly valuable in analog systems where an extra line for transmitting bi-directional data, which is unrelated to the video data, may not be available.

Figure 6:
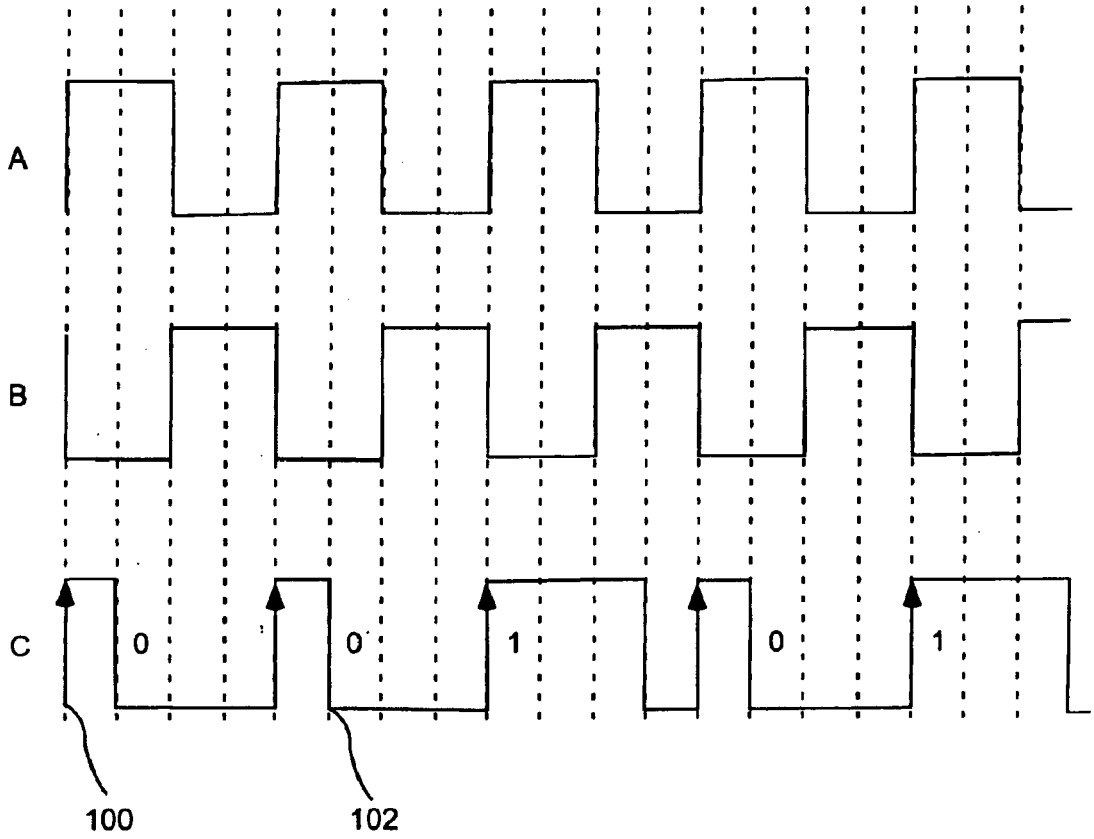
FIG. 6 illustrates a pixel clock signal that is shifted by 1/N of a pixel clock period in an embodiment of the invention.

An additional embodiment of the transmission method can provide a much higher data capacity for outbound host-to-display data. This system and method employs a clock edge modulation scheme on the 1/N pixel rate clock carried on the horizontal sync line as described previously. FIG. 6 illustrates the original 1/N clock signal in waveform A. The positive going edge of this signal 100 shown in wave form C can be used as the timing reference for the generation of the display's pixel sampling clock, and also for a recovered 50% duty cycle, 1/N rate clock. In addition, the position of the falling edge 102 of the transmitted clock can encode the transmitted digital data stream, at the rate of one bit per clock cycle. As shown, an edge 102 is shifted by a defined fraction of the clock period to encode data onto the clock stream. In this example, the clock is modulated or moved by ¼ of a clock period.

This shifted encoding permits the data to be recovered by sampling the clock with an inverted (180 degrees out of phase with the original), 50% duty cycle version of the same clock as illustrated in waveform B of FIG. 6. Sampling the encoded clock on the rising edge of the inverted clock results in a "zero" (low state) being sampled if the edge is advanced by a fraction of a period, and a "one" (high state) if the falling edge is delayed by defined fraction of the clock period (e.g. ¼ of a clock period). This encoding is achieved through a logic circuit that can be made by one skilled in the art. The amount the edge is modulated can vary as long as the amount it is shifted by allows the data to be retrieved by a separate sampling clock. For example, the clock edge can be shifted by ⅛, 1/16, or ⅓ of a clock period.

An example implementation of this system can provide a capacity of ⅛ the number of pixels in the active image format, during each frame time. For a 640×480 pixel image (307,200 pixels per frame), this system could transmit at least ⅛ that number, or 38,400 bits per frame, or at a 60 Hz frame rate this is slightly over 2.3 Mbits/second. This is sufficient for the transmission of standard CD quality stereo digital audio (47.7 Ksamples/sec.×16 bits/sample×2 channels=1.5264 Mbits/sec).

The bidirectional data capability of the vertical sync period transmission scheme described above permits a copy protection system to be implemented on systems using the present system and method. A copy protection system using this method includes a challenge/response model of operation, in which the host can transmit an encrypted "challenge" data string to the display. A response can be provided from the display by decrypting the transmitted data and returning the decrypted data to the host. The decrypted data can be returned during the subsequent frame time to permit time for the decryption to be completed. If incorrect data is returned by the display (or no data is received, indicating an incompatible/older display device), the host would immediately disable the video outputs. Re-enabling the video output can occur when (a) the display responds correctly to the challenge, or (b) the video to be transmitted no longer requires copy protection. This technique can make use of a public key encryption technique, in which all hosts use a predetermined public key in their data encryption step, but authorized displays receive an assigned private key in order to complete the decryption step. The data encrypted by the host (and to which the returned data will be compared) can be generated by any of a number of methods. However, a random number generator can be used to create the encrypted data, if desired.

It is also significant that the present invention is able to transmit data that is unrelated to the horizontal sync data over a horizontal sync line. This allows the present invention to send data between the host and the video display without requiring additional physical lines in the video interface. Moreover, signal lines that have been used for analog sync data have not been used in the past to send data that is unrelated to the video signal because those skilled in the art in this area have thought of the horizontal sync line as being already occupied. The present invention allows the horizontal sync signal and data on the horizontal sync line to co-exist. This increases the functionality of a limited video interface without increasing the physical requirements of the system.

Another benefit of transmitting the data on the horizontal sync line or with the pixel clock signal is that the data is more tightly coupled to video signal. The device which is receiving the data is more likely to be the device that is displaying the video data. This is because it is relatively difficult to separate the data from the data line in this invention. For example, it is more difficult for an individual to read data combined with a clock and sync signal if they are trying to illegitimately access the data sent to the video display. In contrast, data sent on a separate line such as the DDC line in the VGA definition is already separated from the video line data which increases the opportunity for data to be separated from the video signal and accessed independently. Further, the embodiments of the present invention that encode the data on the pixel clock provide a much higher speed data channel than many other data transfer mechanisms such as the DDC line which is just 100 K/bits per second.

Figure 7:
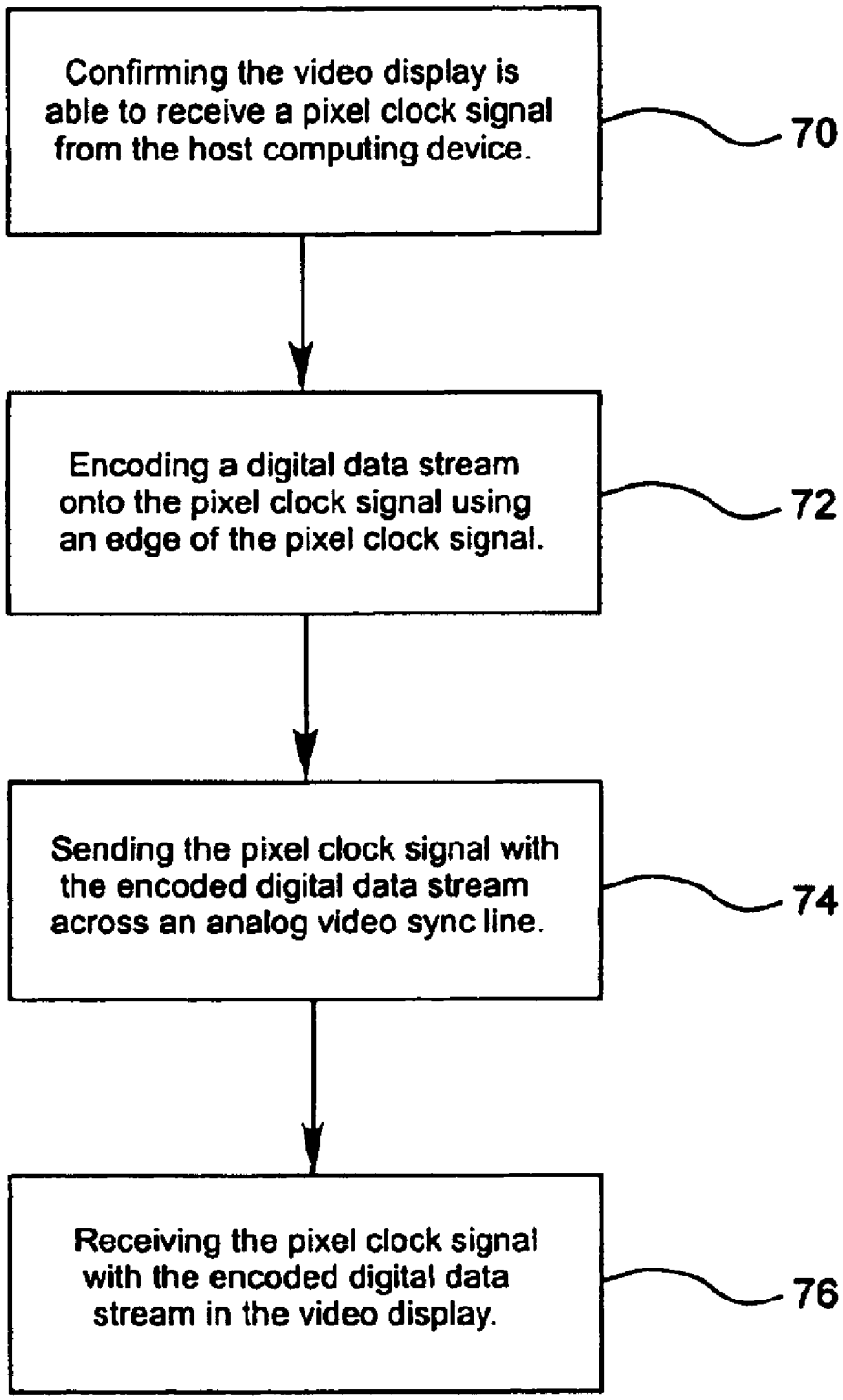
FIG. 7 is a flowchart showing an embodiment of operations involved in a method for transferring data through a video interface.

FIG. 7 is a flowchart showing steps in a method for transferring data between a host computing device and a video display via a video interface. The method includes the step of confirming that the video display is able to receive a pixel clock signal from the host computing device in block 70. Another step is encoding a digital data stream onto the pixel clock signal using an edge of the pixel clock signal in block 72. A further step is sending the pixel clock signal with the encoded digital data stream across an analog video sync line in block 74. An additional step is receiving the pixel clock signal with the encoded digital data stream in the video display in block 76.

The method of sending the digital data stream can encode the digital data stream on the falling edge of the pixel clock signal at the rate of one bit per clock cycle. One method of encoding the digital data stream on the falling edge of the pixel clock signal is by advancing the falling edge of the clock period by one-fourth of the clock period to represent a digital 0 or by delaying the falling edge of the clock period by one-fourth of the clock period to represent a digital 1.

This system and method can be used in other host to video display interfaces. As described above, this proposed analog interface is fully supportable on the existing VGA standard connection. However, the present invention can also be used with other physical interfaces and the enhanced interface will potentially benefit from the improved electrical performance of more modem connections. Three physical connections which have generated the most current interest are the VESA Plug & Display (P&D) standard, the M1 interface standards, and the Digital Visual Interface (DVI) interface specification from the Digital Display Working Group. All three interfaces are taken from the same family, employing the MicroCross™ pseudo coaxial connection for the analog video signal lines (developed by Molex Corp.). The primary difference between these standards in terms of the physical connection is the number of pins, in addition to the four pin MicroCross™ provided by each connector. The VESA connectors each provide 30 additional pin positions (organized as three rows of ten pins each), while the DDWG connector is slightly smaller, providing only 24 additional pins (3 rows of eight).

For example, the M1 definition has a sufficient number of reserved pins so as to easily redefine two pins to carry the /CLK_ENABLE and /PULSE_ENABLE signals from the display to the host. The DVI connector at present has no free pins, and so these flags could not be added as dedicated lines. Should it become desirable to support this enhanced video system on the DVI connector, it is recommended that these be communicated via the DDC/CI system.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A method for transferring data between a host and a video display through an analog video interface, comprising the steps of:

providing a horizontal sync line for the analog video interface between the host and the video display with time intervals that are reserved for a horizontal sync signal;

signaling to the host that the video display is able to participate in bidirectional data communications using the horizontal sync line of the analog video interface; and transferring data between the host and video display on the horizontal sync line of the analog video interface during time intervals that are not reserved for the horizontal sync signal.

2. A method as in claim 1, further comprising the step of providing a vertical sync line with time intervals reserved for vertical sync signals that are sent during pro-determined intervals when the horizontal sync signal is not occupying the horizontal sync line.

3. A method as in claim 2, further comprising the step of sending data communications on the horizontal sync line when the vertical sync line is sending vertical sync signals.

4. A method as in claim 3, further comprising the step of sending outbound serial data from the host to the display on the horizontal sync line wing up to one-half of the vertical sync signal time interval.

5. A method as in claim 3, further comprising the step of receiving inbound serial data from the display for the host on the horizontal sync line using up to one-half of vertical sync signal time interval.

6. A method as in claim 1, further comprising the steps of:

loading a data communications driver in the host to send communications data to the video display;

sending data from the host to the video display on an analog video line.

7. A method as in claim 6, further comprising the steps of:

removing the data driver from the host for the horizontal sync line to enable the host to receive data from the video display; and sending data from video display to the host on the horizontal sync line.

8. A method as in claim 1, transmitting the data using the falling edge of a clock signal transmitted on the horizontal sync line.

9. A method as in claim 8, further comprising the step of transmitting the data on the clock signal at 1/N of the video display's pixel rate.

10. A video display system for transferring data via an analog video interface between a host computing device and a video display, comprising:

an analog video display adapter located in the host computing device;

a video display configured to receive and display video signals from the analog video display adapter;

a horizontal sync line configured to provide a horizontal sync signal from the analog video display adapter to the video display;

a clock enable line, coupled to the analog video display adapter, and configured to provide a signal from the video display indicating that clock information can be sent across the horizontal sync line;

a pixel clock signal configured to be used in sampling the pixels in the video display using an analog video signal, and the pixel clock signal is sent on the horizontal sync line during time intervals that are not reserved for the horizontal sync signal; and a digital data stream transmitted to the video display on the pixel clock signal using an edge of the pixel clock signal, wherein the digital data stream is encoded on a falling edge of the pixel clock signal at the rate of one bit per clock cycle.

11. A system as in claim 10, wherein the digital data stream is encoded on the falling edge of the pixel clock signal by shifting the failing edge of the clock period by ¼ of the clock period.

12. A system as in claim 10, wherein the digital data stream is encoded on the falling edge of the pixel clock signal by advancing the falling edge of the clock period by 1/N of the clock period to represent a digital 0.

13. A system as in claim 10, wherein the digital data stream is encoded on the falling edge of the pixel clock signal by delaying the falling edge of the clock period by 1/N of the clock period to represent a digital 1.

14. A system as in claim 10, further comprising an inverted pixel clock signal in the video display to recover the digital data stream from the pixel clock signal.

15. A system as in claim 10, wherein the pixel clock signal is a 1/N pixel clock.

16. A method for transferring data between a host computing device and a video display via an video interface, comprising the steps of:

confirming that the video display is able to receive a pixel clock signal from the host computing device;

encoding a digital data stream onto the pixel clock signal using an edge of the pixel clock signal;

sending the pixel clock signal with the encoded digital data stream across an analog video sync line;

receiving the pixel clock signal with the encoded digital data stream in the video display.

17. A method as in claim 16, further comprising the step of recovering the digital data stream from the pixel clock signal using an inverted pixel clock signal in the video display.

18. A method as in claim 16, wherein the video interface man analog video interface.

19. A method claim 16, step of encoding digital data stream further comprises the step of encoding the digital data stream on the falling edge of the pixel clock signal at the rate of one bit per clock cycle.

20. A method as in claim 16, wherein the step of encoding a digital data stream further comprises the step of encoding the digital data stream on the falling edge of the pixel clock signal by shifting the falling edge of the clock period by one-fourth of the clock period.

21. A method as in claim 18, wherein the step of encoding the digital data stream on the falling edge of the pixel clock signal at the step of one bit per clock cycle.

22. A method as in claim 18, wherein the step of encoding the digital data stream on the falling edge of the pixel clock signal by delaying the falling edge of the clock period by ¼ of the clock period.

23. A method as in claim 16, wherein the step of encoding the digital data stream across an video sync line, further comprises the step of sending the pixel clock signal by advancing the video display.

24. A method as in claim 23, sending the pixel clock signal on the horizontal sync line during time intervals that are not reserved for the horizontal sync signal.

25. A video display system for transferring data via an analog video interface between a host computing device and a video display, comprising:

an analog video display adapter for positioning in the host computing device;

a video display means for receiving and displaying video signals from the analog video display adapter;

a horizontal sync means for providing a horizontal sync signal from the analog video display adapter to the video display means;

a clock enable means, coupled to the analog video display adapter, for providing a signal from the video display means indicating that clock information can be sent across the horizontal sync means;

a pixel clock signal means for sampling the pixels in the video display means using an analog video signal, and the pixel clack signal means is sent on the horizontal sync means during time intervals that are not reserved for the horizontal sync signal; and a digital data stream transmitted on the pixel clock signal means using an edge of the pixel clock signal, wherein the digital data stream is encoded on a falling edge of the pixel clock signal means at a rate of one bit per clock cycle.

* * * * *